US010865728B2

(12) United States Patent
Plamondon et al.

(10) Patent No.: US 10,865,728 B2
(45) Date of Patent: Dec. 15, 2020

(54) METHOD OF USING BACKFLOW FROM COMMON-RAIL FUEL INJECTOR

(71) Applicant: PRATT & WHITNEY CANADA CORP., Longueuil (CA)

(72) Inventors: Etienne Plamondon, Candiac (CA); Sebastien Bergeron, Chambly (CA); Benjamin Renaud, Montreal (CA); Jean-Gabriel Gauvreau, Varennes (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/352,030

(22) Filed: Mar. 13, 2019

(65) Prior Publication Data

US 2020/0232409 A1 Jul. 23, 2020

Related U.S. Application Data

(63) Continuation-in-part of application No. 16/251,512, filed on Jan. 18, 2019.

(51) Int. Cl.

| | |
|---|---|
| ***F02D 41/38*** | (2006.01) |
| ***F02D 41/30*** | (2006.01) |
| ***F02M 99/00*** | (2006.01) |
| ***F02D 7/00*** | (2006.01) |

(52) U.S. Cl.

CPC ..... *F02D 41/3845* (2013.01); *F02D 7/007* (2013.01); *F02D 41/3094* (2013.01); *F02D 41/3863* (2013.01); *F02M 99/00* (2013.01)

(58) Field of Classification Search

CPC ..... F02D 41/3845; F02D 41/3094; F02D 41/3868; F02D 7/007; F02D 99/00; F02D 33/003; F02M 37/0052; F02M 37/0029

USPC ..... 123/445, 510, 459, 463

See application file for complete search history.

(56) References Cited

U.S. PATENT DOCUMENTS 4,176,641 A * 12/1979 Perr ..... F02D 7/007 123/383
4,217,862 A 8/1980 Fort et al.
4,300,502 A * 11/1981 Driggers ..... F02M 37/0023 123/389

(Continued)

FOREIGN PATENT DOCUMENTS

EP 2426344 2/2015

OTHER PUBLICATIONS

Advisory Action dated May 19, 2020, U.S. Appl. No. 16/251,512.

*Primary Examiner* — Mahmoud Gimie

(74) *Attorney, Agent, or Firm* — Norton Rose Fulbright Canada LLP

(57) ABSTRACT

There is disclosed a method of operating an engine assembly including a combustion engine and a common-rail injector. The method includes: injecting fuel into a combustion chamber of the combustion engine via the common-rail injector thereby generating a backflow of fuel; and powering an actuator using at least a portion of the backflow of fuel. An engine assembly including the combustion engine is disclosed; the engine assembly having a fuel circuit fluidly connecting a fuel source, the common-rail injector, and the second injector outlet together. The fuel circuit has an actuator sub-circuit operatively connected to an outlet of the common-rail injector and an actuator fluidly connected to the actuator sub-circuit.

20 Claims, 3 Drawing Sheets

(56) References Cited

U.S. PATENT DOCUMENTS 4,411,239 A 10/1983 Kelch
5,794,598 A 8/1998 Janik
6,142,127 A 11/2000 Maass
6,234,151 B1 5/2001 Eck
6,257,208 B1 7/2001 Harvey
6,397,826 B1 6/2002 Coleman
6,520,162 B1 * 2/2003 Schueler ..... F02M 37/22 123/198 D
7,637,252 B2 12/2009 Jung et al.
7,640,919 B1 * 1/2010 Smith ..... F02M 37/0029 123/469
7,658,181 B2 * 2/2010 Dickenscheid ..... F02M 37/025 123/509
7,753,036 B2 7/2010 Lents et al.
7,775,044 B2 8/2010 Julien et al.
7,874,284 B2 1/2011 Sano
8,166,943 B2 5/2012 Chamarthi
9,080,518 B2 7/2015 Pursifull
2003/0111052 A1 * 6/2003 Schueler ..... F02M 53/00 123/446
2003/0183198 A1 * 10/2003 Mahr ..... F02M 47/027 123/447
2004/0003794 A1 * 1/2004 Mahr ..... F02M 57/025 123/447
2006/0169252 A1 * 8/2006 Ludwig ..... F02M 37/106 123/447
2006/0185647 A1 * 8/2006 Rapp ..... F02M 45/00 123/446
2007/0039865 A1 * 2/2007 Jiang ..... B01D 36/003 210/259
2008/0156082 A1 7/2008 Scheid
2008/0203347 A1 * 8/2008 Burrola ..... F02M 55/04 251/284
2011/0146625 A1 * 6/2011 Male ..... F02M 37/0029 123/459
2011/0168133 A1 * 7/2011 Pursifull ..... F02M 37/0064 123/495
2012/0216778 A1 8/2012 Fulton
2013/0024092 A1 * 1/2013 Klesse ..... F02D 41/3845 701/103
2013/0138327 A1 5/2013 Kojima
2015/0152800 A1 * 6/2015 Male ..... F02D 33/003 137/544
2015/0204293 A1 * 7/2015 Ritsch ..... F02M 63/028 123/468
2018/0128219 A1 * 5/2018 Kapp ..... F02M 37/0035
2018/0187601 A1 7/2018 Segura Martinez De Ilarduya et al.
2018/0347491 A1 12/2018 Rousseau
2019/0107106 A1 * 4/2019 Hagihara ..... F04B 23/04

* cited by examiner

METHOD OF USING BACKFLOW FROM COMMON-RAIL FUEL INJECTOR

CROSS-REFERENCE TO RELATED APPLICATIONS

The present application claims priority on U.S. patent application Ser. No. 16/251,512 filed Jan. 18, 2019, the entire contents of which are incorporated herein by reference.

TECHNICAL FIELD

The application relates generally to combustion engines and, more particularly, to fuel systems of such engines.

BACKGROUND

Combustion engines include at least one combustion chamber into which fuel is provided, typically by a fuel injector. Some fuel injectors, such as common-rail injectors, generate a backflow of fuel that can reach high temperature during engine operation. The fuel has to be highly pressurized first before being expanded, and heat may be generated as a result of the pressure change and/or the expansion of the backflow. This backflow is returned directly back to the fuel tank. The backflow of fuel in common rail injectors is established as soon as the injection process is enabled, and increases with the amount of fuel being injected for a given injection pressure. A pressure of the backflow is maintained within certain pressure limits to maintain the injection behavior variability within a small range. Better and more efficient fuel management in such fuel systems is desired.

SUMMARY

In one aspect, there is provided a method of operating an engine assembly including a combustion engine and fuel system having a common-rail injector, the method comprising: injecting fuel into a combustion chamber of the combustion engine via the common-rail injector thereby generating a backflow of fuel; and powering an actuator using at least a portion of the backflow of fuel from the common-rail injector.

In another aspect, there is provided a method of operating an actuator operatively connected to a fuel injection system of a combustion engine, the fuel injection system having a common-rail injector, the method comprising: drawing fuel from a fuel source; limiting the drawn fuel from flowing toward an actuator; and powering the actuator by opening a valve to allow fuel to flow to the actuator using at least a portion of a backflow of fuel generated by the common-rail injector.

In yet another aspect, there is provided an engine assembly comprising: a combustion engine having at least one combustion chamber; a fuel injection system having a common-rail injector fluidly connected to a fuel source, the common-rail injector having a first injector outlet fluidly connected to a combustion chamber providing fuel thereto, and a second injector outlet outputting a backflow of fuel; a fuel circuit fluidly connecting the fuel source, the common-rail injector, and the second injector outlet together; the fuel circuit having an actuator sub-circuit operatively connected to the second injector outlet; and an actuator fluidly connected to the actuator sub-circuit.

BRIEF DESCRIPTION OF THE DRAWINGS

Reference is now made to the accompanying figures in which.

DETAILED DESCRIPTION

Figure 1:
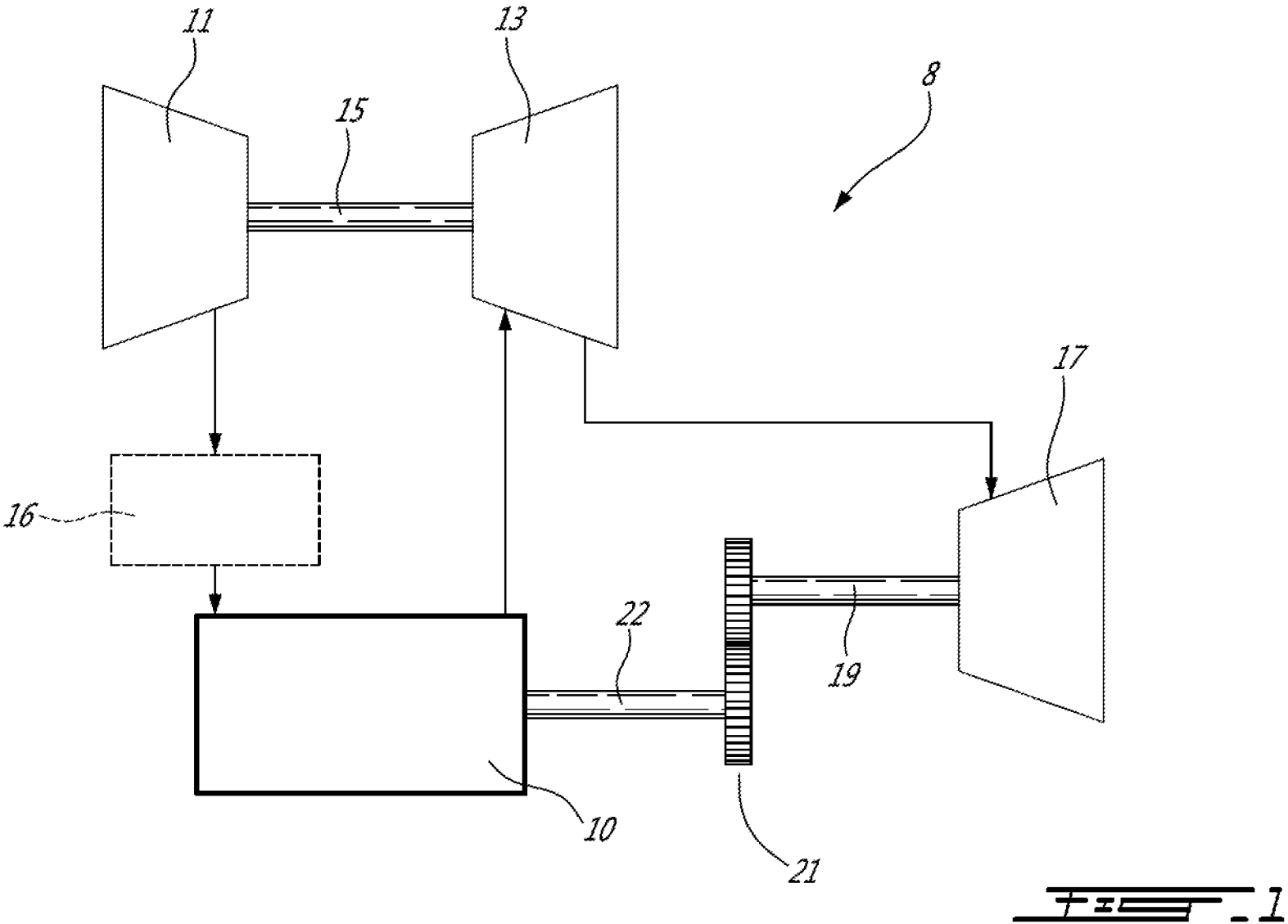
FIG. 1 is a schematic diagram of a compound engine system.

Referring to FIG. 1, a compound engine system 8 is schematically shown. The system 8 includes a compressor 11 and a turbine 13 which are connected by a shaft 15, and which act as a turbocharger to one or more rotary engines 10. The compressor 11 may be a single-stage or multiple-stage centrifugal device and/or an axial device. A rotary engine 10, or a plurality of rotary engines, receives compressed air from the compressor 11. The air optionally circulates through an intercooler 16 between the compressor 11 and the rotary engine(s) 10.

The exhaust gas exiting the rotary engine 10 is supplied to the compressor turbine 13 and also to a power turbine 17, the turbines 13, 17 being shown here in series, i.e. with the exhaust gas flowing first through one of the two turbines where the pressure is reduced, and then through the other turbine, where the pressure is further reduced. In an alternate embodiment (not shown), the turbines 13, 17 are arranged in parallel, i.e. with the exhaust gas being split and supplied to each turbine at same pressure. In another alternate embodiment, only one turbine is provided.

Energy is extracted from the exhaust gas by the compressor turbine 13 to drive the compressor 11 via the connecting shaft 15, and by the power turbine 17 to drive an output shaft 19. The output shaft 19 may be connected via a gear system 21 to a shaft 22 connected to the rotary engine(s) 10. The combined output on the shafts 19, 22 may be used to provide propulsive power to a vehicle application into which the system 8 is integrated. This power may be delivered through a gearbox (not shown) that conditions the output speed of the shafts 19, 22 to the desired speed on the application. In an alternate embodiment, the two shafts 19, 22 may be used independently to drive separate elements, e.g. a propeller, a helicopter rotor, a load compressor or an electric generator depending whether the system is a turboprop, a turboshaft or an APU (Auxiliary Power Unit).

Although not shown, the system 8 also includes a cooling system, including a circulation system for a coolant to cool the outer body of the rotary engine (e.g. water-ethylene, oil, air), an oil coolant for the internal mechanical parts of the rotary engine, one or more coolant heat exchangers, etc.

The compound engine system 8 may be as described in Lents et al.'s U.S. Pat. No. 7,753,036 issued Jul. 13, 2010 or as described in Julien et al.'s U.S. Pat. No. 7,775,044 issued Aug. 17, 2010, the entire contents of both of which are incorporated by reference herein.

Figure 2:
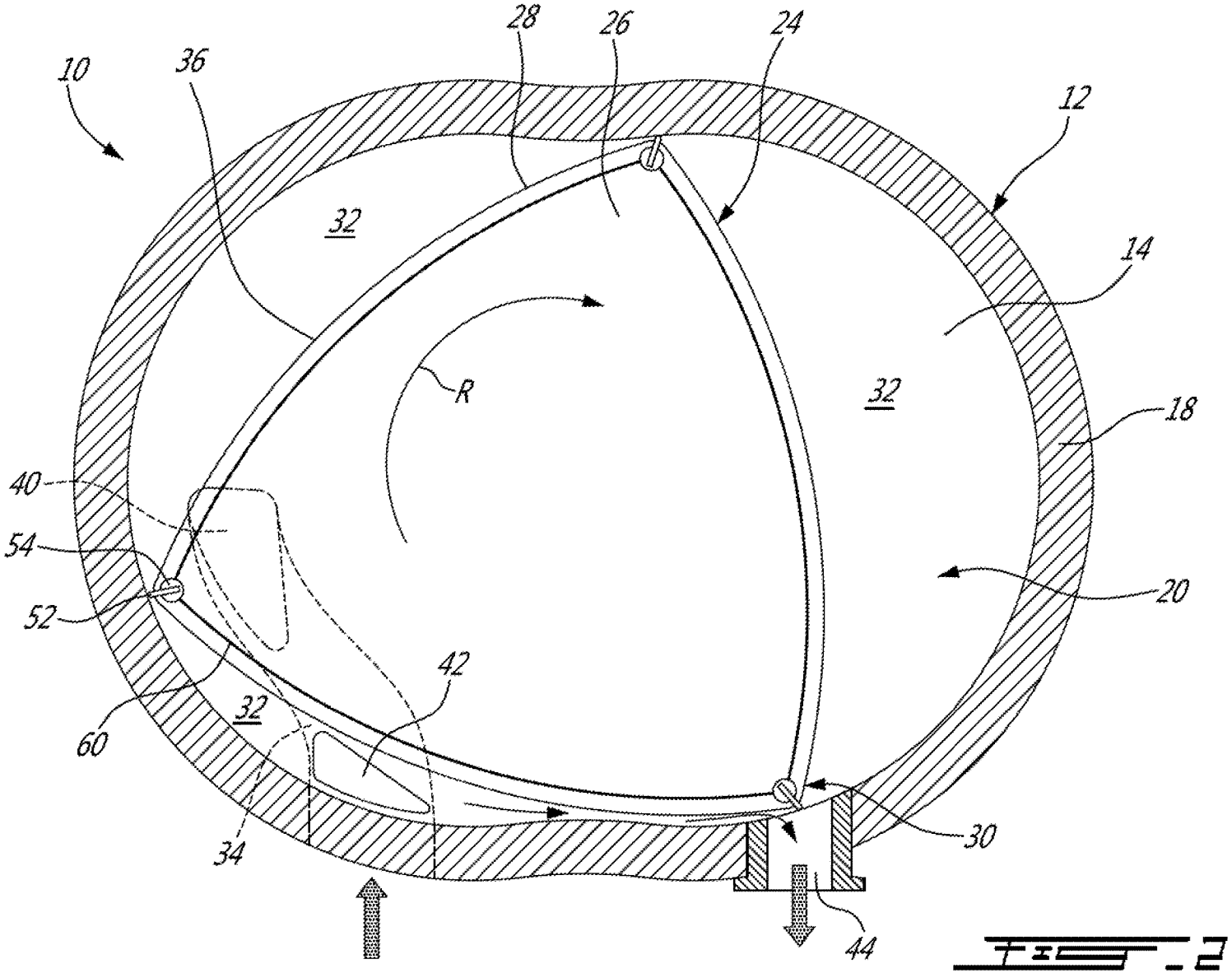
FIG. 2 is a schematic cross-sectional view of a rotary internal combustion engine, and which can be used in a system such as shown in FIG. 1.

In at least one embodiment, the rotary engine 10 forms a core of the compound cycle engine system 8. Referring now to FIG. 2, the rotary internal combustion engine 10, known as a Wankel engine, is schematically shown. The rotary combustion engine 10 comprises an outer body 12 having axially-spaced end walls 14 with a peripheral wall 18 extending therebetween to form a rotor cavity 20. The inner surface of the peripheral wall 18 of the cavity 20 has a profile defining two lobes, which is preferably an epitrochoid.

An inner body or rotor 24 is received within the cavity 20. The rotor 24 has axially spaced end faces 26 adjacent to the outer body end walls 14, and a peripheral face 28 extending therebetween. The peripheral face 28 defines three circumferentially-spaced apex portions 30, and a generally triangular profile with outwardly arched sides 36. The apex portions 30 are in sealing engagement with the inner surface of peripheral wall 18 to form three rotating combustion chambers 32 between the inner rotor 24 and outer body 12. The geometrical axis of the rotor 24 is offset from and parallel to the axis of the outer body 12.

The combustion chambers 32 are sealed. In the embodiment shown, each rotor apex portion 30 has an apex seal 52 extending from one end face 26 to the other and biased radially outwardly against the peripheral wall 18. An end seal 54 engages each end of each apex seal 52 and is biased against the respective end wall 14. Each end face 26 of the rotor 24 has at least one arc-shaped face seal 60 running from each apex portion 30 to each adjacent apex portion 30, adjacent to but inwardly of the rotor periphery throughout its length, in sealing engagement with the end seal 54 adjacent each end thereof and biased into sealing engagement with the adjacent end wall 14. Alternate sealing arrangements are also possible.

Although not shown in the Figures, the rotor 24 is journaled on an eccentric portion of a shaft such that the shaft rotates the rotor 24 to perform orbital revolutions within the stator cavity 20. The shaft rotates three times for each complete rotation of the rotor 24 as it moves around the stator cavity 20. Oil seals are provided around the eccentric to impede leakage flow of lubricating oil radially outwardly thereof between the respective rotor end face 26 and outer body end wall 14. During each rotation of the rotor 24, each chamber 32 varies in volumes and moves around the stator cavity 20 to undergo the four phases of intake, compression, expansion and exhaust, these phases being similar to the strokes in a reciprocating-type internal combustion engine having a four-stroke cycle.

The engine includes a primary inlet port 40 in communication with a source of air, an exhaust port 44, and an optional purge port 42 also in communication with the source of air (e.g. a compressor) and located between the inlet and exhaust ports 40, 44. The ports 40, 42, 44 may be defined in the end wall 14 of in the peripheral wall 18. In the embodiment shown, the inlet port 40 and purge port 42 are defined in the end wall 14 and communicate with a same intake duct 34 defined as a channel in the end wall 14, and the exhaust port 44 is defined through the peripheral wall 18. Alternate configurations are possible.

In a particular embodiment, fuel such as kerosene (jet fuel) or other suitable fuel is delivered into the chamber 32 through a fuel port (not shown) such that the chamber 32 is stratified with a rich fuel-air mixture near the ignition source and a leaner mixture elsewhere, and the fuel-air mixture may be ignited within the housing using any suitable ignition system known in the art (e.g. spark plug, glow plug). In a particular embodiment, the rotary engine 10 operates under the principle of the Miller or Atkinson cycle, with its compression ratio lower than its expansion ratio, through appropriate relative location of the primary inlet port 40 and exhaust port 44.

Figures 3, 4:
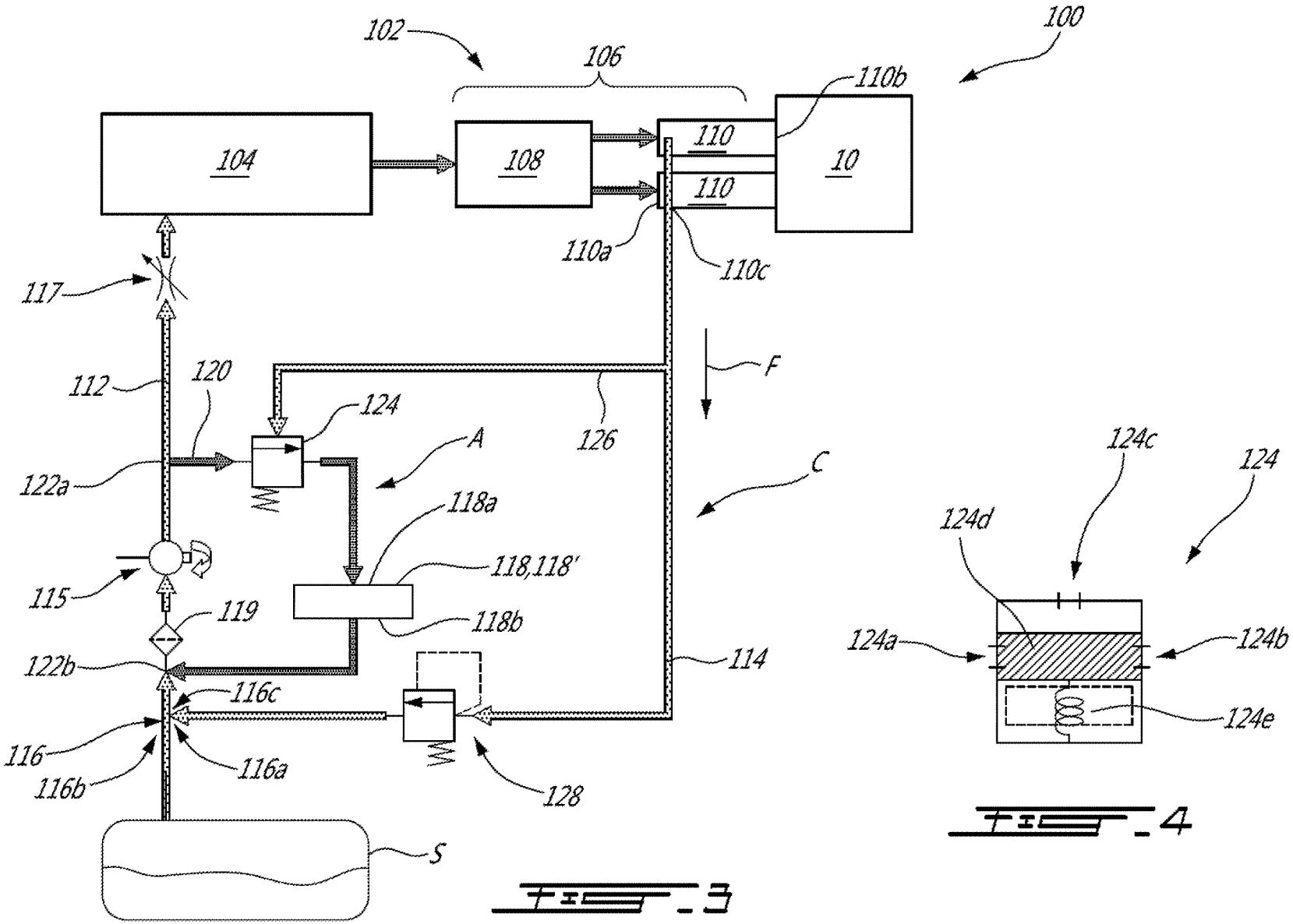
FIG. 3 is a schematic view of an engine assembly in accordance with one embodiment.
FIG. 4 is a schematic view of a minimum pressure valve in accordance with one embodiment.

Referring to FIG. 3, an engine assembly is generally shown at 100. In one particular embodiment, the engine assembly 100 may incorporate the compound cycle engine system 8 described herein above with reference to FIG. 1 and/or may include the rotary engine 10 described above with reference to FIG. 2.

The engine 10 of the engine assembly 100 as shown in FIG. 3 may however be any combustion engine, including but not limited to a gas turbine engine, a piston engine, a rotary engine, and so on. The engine 10 of the disclosed engine assembly 100 may also be implemented as a gas turbine engine used as an Auxiliary Power Unit (APU) in an aircraft. Accordingly, the term "combustion engine" as used herein is understood to include all of these types of engines (reciprocating internal combustion engines such as piston engines, rotating internal combustion engines such as rotary or Wankel engines, continuous flow engines such as gas turbine engines, etc.), and is therefore defined as any engine having one or more combustion chambers and having a fuel system feeding fuel to the combustion chamber(s). As will be described further below, the fuel injection system 102 of the present engine assembly 100 uses common rail fuel injection.

The engine assembly 100 includes a fuel injection system 102 for providing fuel to the internal combustion engine 10 from a source of fuel S, which, in the embodiment shown, comprises a fuel tank. As shown, the fuel injection system 102 includes high-pressure pumps 104 and a common-rail injector 106 fluidly connected to the high-pressure pumps 104. The common-rail injector 106 includes a common rail 108 and individual injectors 110. The common-rail 108 is in fluid communication with each of the injectors 110.

Each of the fuel injectors 110 includes an inlet 110*a*, a first outlet 110*b*, and a second outlet 110*c*; the first and second outlets 110*b*, 110*c* being fluidly connected to the inlet 110*a*. The inlet 110*a* of each of the injectors 110 is fluidly connected to the fuel source S, in the embodiment shown via the high-pressure pump(s) 104 and the common rail 108. The first outlet 110*b* is fluidly connected to the combustion chamber 32 (FIG. 2) of the combustion engine 10. The second outlet 110*c* is configured for expelling a backflow of fuel F.

In a particular embodiment, the injector 110 includes housings and pistons movable within the housings from a first position in which the piston blocks the first outlet 110*b* of the injector 110 to a second position in which the piston is distanced from the first outlet 110*b* for allowing the fuel from the source of fuel S to be injected in the combustion chamber 32 (FIG. 2). Movement of the piston is induced by a pressure differential created by the high-pressure pumps 104. When the piston moves from the first position to the second position, a portion of the fuel that enters the injector 110 via its inlet 110*a* is not injected in the combustion chamber 32 and is expelled out of the injector 110 while bypassing the combustion chamber 32. The backflow F corresponds to this portion of the fuel that is expelled via the second outlet 110*c* of the fuel injector 110.

The temperature and pressure of the fuel increases as a result of its passage through the high-pressure pumps 104. In use, the fuel that exits the injector 110 via the second outlet 110*c* can reach relatively high temperatures during the expansion process from the high pressure common-rail inlet to the low pressure circuit. As will be seen herein below, it is herein proposed to use this source of energy to enable various system functionalities (e.g. to use the pressure of the backflow F of fuel).

The fuel injection system 102 further has a fuel circuit C including a main conduit 112, for supplying the fuel from the source of fuel S to the injector 110, and a return conduit 114 for receiving the backflow F of fuel.

In the embodiment shown, a connector 116 connects the return conduit 114 to the main conduit 112. More specifically, the connector 116 has a first inlet 116*a*, a second inlet

116*b*, and one outlet 116*c*; the first and second inlets 116*a*, 116*b* being fluidly connected to the outlet 116*c*. The outlet 116*c* of the connector 116 is fluidly connected to the main conduit 112, which is, in turn, fluidly connected to the inlet side of the pump 104 and, thus, to the common rail injector 106. The first inlet 116*a* of the connector 116 is fluidly connected to the second outlet 110*c* of the injector 110. The second inlet 116*b* is fluidly connected to the source of fuel S. As shown, the first inlet 116*a* is fluidly connected to the second outlet 110*c* of the injector 110 via the return conduit 114.

The fuel circuit C includes a fuel pump 115, which may be fluidly connected on the main conduit 112 and configured to draw fuel from the fuel source S and to direct the drawn fuel to the high-pressure pumps 104. A metering valve 117 may be fluidly connected to the main conduit 112 upstream of the high-pressure pumps 104 for controlling a flow rate of fuel entering the high-pressure pumps 104. A fuel filter 119 may be fluidly connected to the main conduit 112 upstream of the high-pressure pump 104.

Still referring to FIG. 3, energy from the backflow of fuel F is usually lost as the backflow of fuel F is simply either directed back to the fuel tank or, as shown herein, redirected to the common-rail injector 106 directly via the main fuel conduit 112. Therefore, it might be advantageous to use the energy from the backflow of fuel F.

Numerous actuators on aerospace engines use fuel as their working fluid. To be efficient, these actuators may need a minimum amount of pressure that might be guaranteed through the use of what is called a minimum pressurizing valve (MPV). However, when starting the engine, those valves might not allow the fuel to reach the injection system until it reaches a given amount of pressure. Since the engine does not turn fast enough during cranking, the fuel pump 115 cannot provide enough pressure to open the MPV. Moreover, the actuators also have a great amount of leakage that worsens the previously stated defect.

In the embodiment shown, an actuator 118 is fluidly connected to the fuel circuit C. As illustrated on FIG. 3, the fuel circuit C includes an actuator sub-circuit A having an actuator conduit 120; the actuator 118 being fluidly connected to the actuator conduit 120. In the embodiment shown, the actuator conduit 120 is fluidly connected to the main conduit 112 at two spaced apart connection points 122*a*, 122*b*. In the depicted embodiment, the fuel pump 115 is located between the two connection points 122*a*, 122*b* relative to a flow of fuel circulating in the main conduit 112.

The actuator 118 works by using a pressure difference between its inlet 118*a* and its outlet 118*b* for exerting a force on a movable component to move said component. Consequently, and in a particular embodiment, the two connection points 122*a*, 122*b* may be located anywhere on the fuel circuit C as long as a pressure difference is present between said two connection points 122*a*, 122*b*.

However, the actuator 118 is the most efficient when a pressure of the fuel circulating therethrough, via the actuator conduit 120, is above a given pressure threshold. In other words, the actuator 118 might not work if the fuel directed through it is not at a pressure at least equal to the given pressure threshold. Typically, the pressure is below the given pressure threshold when the combustion engine 10 is starting or cranking. In a starting phase of the combustion engine 10, a fuel flow rate through injectors 110 is less than that in a steady-state phase.

Moreover, during the starting phase, it might be advantageous to use all the available fuel for feeding the injectors 110. In other words, it might be undesirable, during the starting phase, to direct fuel from the main fuel conduit 112 toward the actuator 118 when the engine is in need of fuel for starting.

In the embodiment shown, a minimum pressure valve, referred to herein below as the valve, 124 is used. The valve 124 may be located on the actuator conduit 120 and upstream of the actuator 118 relative to a flow of fuel circulating in the actuator conduit 120. The valve 124 is used to limit or prevent fuel from reaching the actuator 118 until a pressure in the fuel circuit C has reached the given pressure threshold.

An electro-mechanical and interconnect device (EMID) might be used to disable the functionality of the valve 124 during the starting phase. However, such EMID-equipped valve may be expensive and more complex and a simple MPV valve.

In the embodiment shown, the valve 124 is connected to the second injector outlet 110*c* via a bypass conduit 126 of the fuel circuit C; the bypass conduit 126 stemming from the return conduit 114. In other words, the valve 124 may be fluidly connected to the second outlet 110*c* of the injectors 110.

Referring now to FIGS. 3-4, the valve 124 has an inlet 124*a* and an outlet 124*b* fluidly connectable to the inlet 124*a*. The valve 124 further has a control inlet 124*c* whose function is described below.

The valve 124 has a member 124*d* movable between a close position (solid lines) and an open position (dashed lines). In the close position, a flow of fuel to the actuator 118 is limited and, in the open position, the flow of fuel to the actuator 118 is permitted. In other words, the inlet 124*a* of the valve 124 is substantially fluidly disconnected from the outlet 124*b* of the valve 124 in the close position of the member 124*d*. The inlet 124*a* of the valve 124 is fluidly connected to the outlet 124*b* of the valve 124 in the open position of the member 124*d*. In the embodiment shown, the member 124*d* is biased in the close position using a biasing member 124*e*, which may be a spring.

Still referring to FIGS. 3-4, the second injector outlet 110*c* is fluidly connected to the control inlet 124*c* of the valve 124. In the depicted embodiment, the second injector outlet 110*c* is fluidly connected to the control inlet 124*c* of the valve 124 via the bypass line 126. The biasing member 124*e* is selected such that the member 124*d* is movable from the close position to the open position only when a pressure in the bypass conduit 126 is at or above the given threshold. When the pressure becomes sufficiently great, the pressure of the backflow counteracts a force generated by the biasing member 124 and the valve 124 moves to the open configuration in which the inlet 124*a* of the valve 124 is fluidly connected to the outlet 124*a* of the valve 124 and to the actuator 118 such that fuel can flow from the main conduit 112, through the actuator 118, and back to the main conduit 112. As illustrated, the flow of fuel that enters the actuator 118 comes from the main conduit 112 downstream of the pump 115 and returns to the main conduit 112 upstream of the pump 115. Hence, the backflow of fuel F is used to replace the aforementioned EMID.

In the embodiment shown, a pressure regulating valve 128 is used to increase a pressure in the return conduit 114, and in the bypass conduit 126. The pressure regulating device 128 may be, for instance, fix orifices or any suitable pressure regulating device known in the art.

In a particular embodiment, during cranking, the MPV 124 would be forced closed by the means of calibrated spring such that fuel coming from the fuel pump can be provided to the injection system. When the injection is enabled, fuel would start to flow in the fuel return line but the MPV and the pressure regulating device would be tuned such that they would still allow fuel to be provided to the injection system. As soon as the engine lights up, its speed would increase and the fuel return line flow as well, allowing the pressure to build up and therefore, would gradually open the MPV 124. Once open, the MPV might maintain an acceptable level of pressure to the actuator while continuing to provide fuel to the injection system.

The above-described concept could be used for the actuation of any other devices that need an ON/OFF state based on the engine operation condition. That can be applied to components such as de-oiling and de-airing valve, bleed off valve (BOV), etc.

For operating the engine assembly 100, fuel is injected into the combustion chamber 32 of the combustion engine 10 via the common-rail injector 106 thereby generating the backflow of fuel F; and an element 118 is powered using at least a portion of the backflow of fuel F. In the embodiment shown, the element 118' is the actuator 118.

In a particular embodiment, the backflow of fuel may be used to monitor a flow rate of fuel injected in the combustion chamber(s). Monitoring the fuel flow rate of the back flow of fuel may be used to monitor operation of the fuel injection system and to ensure its proper operation. For instance, if the flow rate of the backflow falls below, and/or increases beyond, a given threshold, a notification may be issued indicative of a malfunction in the injection system. The backflow of fuel may be used to power a switch between on and off positions. For instance, the switch may be used to turn a component that needs to be turned on or off in function of a state (on/off) of the combustion engine. The backflow of fuel may be used as a motive flow using a Venturi effect. For instance, the return line may exit the backflow in the fuel tank and, by the Venturi effect, help the pump in drawing fuel in the main fuel conduit. Consequently, the element 118' may be a monitoring system, a switch, and/or a Venturi injector or any other element that may benefit from a pressurized fluid.

Herein, "powering" means that actuation of the element 118', which may be the actuator 118, becomes possible. In other words, the fuel that "powers" the actuator 118 need not circulate through it. In a particular embodiment, the fuel that "powers" the actuator 118 circulates through the actuator 118. In the embodiment shown, the fuel that "powers" the actuator 118 is used to open the valve 124 that allows the fuel to circulate through the actuator 118.

In the embodiment shown, powering the actuator 118 includes opening the valve 124 using the backflow of fuel F to allow fuel to reach the actuator 118. Opening the valve 124 may include diverting a portion of the backflow of fuel F toward the valve 124. Powering the actuator 118 may include allowing a portion of the fuel circulating in the main fuel conduit 112 to flow to the actuator 118 by opening the valve 124 using the backflow of fuel F. Powering the actuator 118 may include moving the member 124*d* from the close position to the open position by counteracting the force generated by the biasing member 124*e* with the backflow of fuel F. In the embodiment shown, the pressure of the backflow of fuel F is increased before opening the valve 124 with the backflow of fuel F. Increasing the pressure of the backflow of fuel F may include circulating the backflow of fuel F through the pressure regulating valve 128. In a particular embodiment, powering the actuator using the backflow of fuel F includes circulating the backflow of fuel F through the actuator 118. In a particular embodiment, a valve may be opened using fuel circulating from the fuel source S to the common-rail injector 106 to allow the backflow of fuel F to reach the actuator 118.

In a particular embodiment, powering the element 118' using the backflow of fuel includes circulating the backflow of fuel through the element. A valve may be opened using fuel circulating from the fuel source to the common-rail injector to allow the backflow of fuel to reach the element.

For operating the actuator 118, the fuel is drawn from the fuel source S; the drawn fuel is limited from flowing toward the actuator 118; and the actuator 118 by opening the valve 124 to allow the fuel to flow to the actuator 118 using at least a portion of the backflow of fuel F generated by the common-rail injector 106.

In the embodiment shown, opening the valve 124 includes diverting a portion of the backflow of fuel F toward the valve 124. In the depicted embodiment, powering the actuator 118 may include allowing a portion of the fuel circulating in the main fuel conduit 112 to flow to the actuator 118. In the illustrated embodiment, opening the valve 124 includes moving the member 124*d* from the close position to the open position by counteracting the force generated by the biasing member 124*e* with the backflow of fuel F.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A method of operating an engine assembly including a combustion engine and a fuel system having a common-rail injector, the method comprising:

injecting fuel into a combustion chamber of the combustion engine via the common-rail injector thereby generating a backflow of fuel;

opening a valve with at least a portion of the backflow of fuel to allow fuel to flow there through; and powering an actuator having a movable component using the fuel flowing through the valve, the movable component of the actuator in driving engagement with a second valve.

2. The method of claim 1, wherein opening the valve includes diverting the at least the portion of the backflow of fuel toward the valve from a return conduit.

3. The method of claim 1, wherein the engine assembly includes a main fuel conduit fluidly connecting a fuel source to the common-rail injector, an actuator fuel conduit stemming from the main fuel conduit between the fuel source and the common-rail injector, the actuator fluidly connected to the actuator fuel conduit, powering the actuator includes allowing a portion of the fuel flowing in the main fuel conduit to flow to the actuator via the actuator fuel conduit by opening the valve using the backflow of fuel.

4. The method of claim 1, wherein the valve is a minimum pressure valve having a member movable from a close position in which a flow of fuel to the actuator is limited to an open position in which the flow of fuel to the actuator is permitted, a biasing member biasing the member in the close position, wherein powering the actuator includes moving the member from the close position to the open position by counteracting a force generated by the biasing member with the backflow of fuel.

5. The method of claim 1, further comprising increasing a pressure of the backflow of fuel before opening the valve with the backflow of fuel.

6. The method of claim 5, wherein increasing the pressure of the backflow of fuel includes flowing the backflow of fuel through a pressure regulating valve.

7. A method of operating an actuator having a movable component, the actuator operatively connected to a fuel injection system of a combustion engine, the fuel injection system having a common-rail injector, the method comprising:

drawing fuel from a fuel source;

limiting the drawn fuel from flowing toward the actuator until a fuel pressure is above a given threshold; and powering the actuator by opening a valve to allow fuel to flow to the actuator using at least a portion of a backflow of fuel generated by the common-rail injector once the fuel pressure is above the given threshold, the movable component of the actuator in driving engagement with a second valve.

8. The method of claim 7, wherein opening the valve includes diverting a portion of the backflow of fuel toward the valve.

9. The method of claim 7, wherein the fuel injection system includes a main fuel conduit fluidly connecting the fuel source to the common-rail injector, an actuator fuel conduit stemming from the main fuel conduit between the fuel source and the common-rail injector, the actuator fluidly connected to the actuator fuel conduit, powering the actuator includes allowing a portion of the fuel flowing in the main fuel conduit to flow to the actuator via the actuator fuel conduit.

10. The method of claim 7, wherein the valve is a minimum pressure valve having a member movable from a close position in which a flow of fuel to the actuator is limited to an open position in which the flow of fuel to the actuator is permitted, a biasing member biasing the member in the close position, wherein opening the valve includes moving the member from the close position to the open position by counteracting a force generated by the biasing member with the backflow of fuel.

11. The method of claim 7, further comprising increasing a pressure of the backflow of fuel before opening the valve with the backflow of fuel.

12. An engine assembly comprising: a combustion engine having at least one combustion chamber; a fuel injection system having a common-rail injector fluidly connected to a fuel source, the common-rail injector having a first injector outlet fluidly connected to a combustion chamber providing fuel thereto, and a second injector outlet outputting a backflow of fuel; a fuel circuit fluidly connecting the fuel source, the common-rail injector, and the second injector outlet together; the fuel circuit having an actuator sub-circuit operatively connected to the second injector outlet; a valve having an inlet connected to the fuel circuit and an outlet connected to the actuator sub-circuit, the valve having an open position in which the fuel circuit is fluidly connected to the actuator sub-circuit through the valve and a closed position in which fluid communication through the valve is limited; an actuator fluidly connected to the actuator sub-circuit, the actuator having a movable member; and a second valve in driving engagement with the movable member of the actuator.

13. The engine assembly of claim 12, wherein the fuel circuit includes a main fuel conduit fluidly connecting the fuel source to the injector inlet and a return conduit fluidly connecting the second injector outlet to the main fuel conduit, the actuator circuit including an actuator conduit stemming fluidly connected to and stemming from the main fuel conduit.

14. The engine assembly of claim 13, further comprising a bypass conduit stemming from the return conduit between the second injector outlet and the main fuel conduit, the bypass conduit fluidly connected to the valve for allowing fuel flowing in the main fuel conduit to flow through the actuator via the actuator conduit.

15. The engine assembly of claim 13, wherein the actuator conduit is fluidly connected to the main fuel conduit at two spaced apart connection points on the main fuel conduit.

16. The engine assembly of claim 13, wherein the valve is fluidly connected to the return conduit.

17. The engine assembly of claim 12, wherein the second valve is a bleed-off valve.

18. The engine assembly of claim 14, wherein the bypass conduit has an outlet connected to a control inlet of the valve, the control inlet disconnected from the inlet and from the outlet of the valve.

19. The engine assembly of claim 15, comprising a pump fluidly connected on the main fuel conduit between the two spaced apart connection points.

20. The engine assembly of claim 12, wherein the actuator has an actuator inlet connected to the fuel circuit at a first location and an actuator outlet connected to the fuel circuit at a second location, a fuel pressure at the first location different than that at the second location.

* * * * *